United States Patent [19]

Stahlecker

[11] Patent Number: 4,858,421

[45] Date of Patent: Aug. 22, 1989

[54] ARRANGEMENT FOR PNEUMATIC FALSE-TWIST SPINNING

[75] Inventor: Fritz Stahlecker, Josef-Neidhart-Strasse 18, 7347 Bad Ueberkingen, Fed. Rep. of Germany

[73] Assignees: Fritz Stahlecker; Hans Stahlecker, both of Fed. Rep. of Germany

[21] Appl. No.: 308,461

[22] Filed: Feb. 10, 1989

[30] Foreign Application Priority Data

Mar. 30, 1988 [DE] Fed. Rep. of Germany ..... 3810846

[51] Int. Cl.[4] ..... D01H 5/28; D01H 11/00; D01H 15/02; D01H 1/00

[52] U.S. Cl. ..... 57/328; 57/261; 57/304; 57/305; 57/350

[58] Field of Search ..... 57/261, 315, 328, 333, 57/305, 350, 262, 263, 22, 304

[56] References Cited

U.S. PATENT DOCUMENTS

| | | | |
|---|---|---|---|
| 4,107,911 | 8/1978 | Yamana et al. | 57/261 X |
| 4,114,358 | 9/1978 | Tsuchida et al. | 57/328 X |
| 4,169,350 | 10/1979 | Yamana et al. | 57/261 X |
| 4,503,662 | 3/1985 | Horiuchi et al. | 57/261 |
| 4,543,776 | 10/1985 | Seiki et al. | 57/328 X |
| 4,545,193 | 10/1985 | Tanaka et al. | 57/261 |
| 4,550,560 | 11/1985 | Tanaka et al. | 57/261 |
| 4,620,413 | 11/1986 | Anahara et al. | 57/328 X |

*Primary Examiner*—John Petrakes
*Attorney, Agent, or Firm*—Barnes & Thornburg

[57] ABSTRACT

In an arrangement for pneumatic false-twist spinning, an air nozzle, which follows the pair of delivery rollers of the drafting unit, can be moved out of its operating position after a yarn breakage. At the same time, a suction tube, which is assigned to this pair of delivery rollers, is brought into the area of the clamping gap of the pair of delivery rollers. In the normal operation, this suction tube is in a cleaning position, in which it is aimed at the circumference of a roller of the pair of delivery rollers.

8 Claims, 1 Drawing Sheet

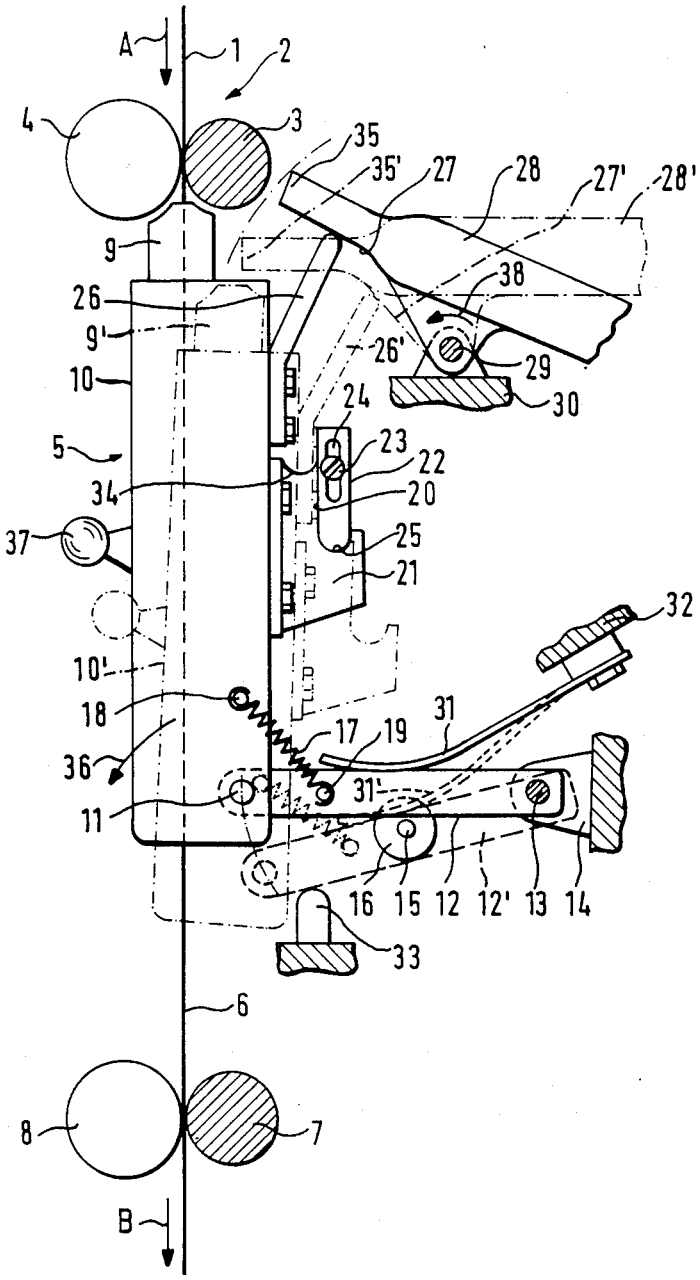
A
1
2
4
3
35
35'
27
28
27'
28'
9
38
26
9'
26'
29
10
30
24
5
23
22
34
20
37
25
21
32
10'
18
31
17
19
36
31'
11
16
15
12
12'
13
14
33
6
8
7
B

ARRANGEMENT FOR PNEUMATIC FALSE-TWIST SPINNING

BACKGROUND AND SUMMARY OF THE INVENTION

The invention relates to an arrangement for pneumatic false-twist spinning of the type having a drafting unit, at least one air nozzle which follows the drafting unit in the travel direction of the yarn, a withdrawal device, and devices for transferring the movably held air nozzle from an operating position behind a pair of delivery rollers of the drafting unit into a piecing position which is offset with respect to the pair of delivery rollers. A movably held suction tube is provided which can be brought into a piecing position by means of adjusting devices when the air nozzle is moved out of the operating position, in which piecing position the suction tube is applied to the area of the clamping gap of the pair of delivery rollers of the drafting unit.

An arrangement of the initially mentioned type is described in German Patent Application No. P 36 38 110.1, which is no prior publication and related pending commonly owned U.S. Pat. appication Ser. No. 07/108,218, filed Oct. 14, 1987, now U.S. Pat. No. 4,819,419. By means of this construction, a piercing process becomes possible, in which the drafting unit is restarted, before the start of the actual piecing operation, so that the piecing process is carried out even when the drafting unit is already running. The sliver, which was supplied by the drafting unit before the piecing operation, which possibly was not drawn correctly, is sucked off by means of the suction tube and does not enter the yarn. Only the sliver, which is sucked up by means of the air nozzles, which were returned to the operating position, is bound into the forming yarn. As a result, it is also possible to carry out the piecing without any returning of a yarn against the normal moving direction through the air nozzles into the area of the drafting unit.

An object of the invention is to simplify the construction and to provide an additional function to the suction tube which, during the whole operating period, was connected to a vacuum source.

This object is achieved in that, when the air nozzle is in the operating position, the suction tube is in a cleaning position, in which it is aimed at the circumference of one roller of the pair of delivery rollers of the drafting unit at a distance from the clamping gap.

By means of this construction, the suction tube is disposed at a sufficient distance from the clamping gap during the operation, without having to carry out an excessively large movement. The sucking-up of fibers is therefore avoided. At the same time, it carries out a cleaning function.

In a further development of preferred embodiments of the invention, it is provided that the suction tube is arranged on a holder and can be swivelled between the piecing position and the cleaning position. This type of a swivelling holding arrangement is particularly easy to implement.

In a further development of the invention, it is provided that the suction tube is coupled with the air nozzle in such a manner that it follows the movement of the air nozzle such that, when the air nozzle is located in the piecing position, the suction tube is also located in the piecing position. It is therefore sufficient to provide adjustable actuating devices only for the air nozzle, while the suction tube is taken along automatically into the respective position.

Other objects, advantages and novel features of the present invention will become apparent from the following detailed description of the invention when considered in conjunction with the accompanying drawings.

BRIEF DESCRIPTION OF THE DRAWINGS

The single drawing FIGURE shows a schematic representation of an arrangement constructed according to a preferred embodiment of the invention.

DETAILED DESCRIPTION OF THE DRAWINGS

The single drawing FIGURE schematically depicts one spinning unit of a spinning machine which comprises a plurality of identical spinning units arranged adjacent one another.

By means of these spinning units, either finished spun yarn can be produced, or an only prestrengthened yarn can be produced which is preferably wound up side-by-side with a second yarn, and later, together with this second yarn, is processed into a twisted yarn.

Each arrangement contains a drafting unit 2, of which only the pair of delivery rollers 3, 4 is shown. The shaded roller 3 is a so-called bottom cylinder, i.e., a shaft, which extends in the longitudinal direction of the machine and is driven at the machine end. A sliver 1 moves through the drafting unit 2 in the direction of the arrow (A) and, in the process, is drawn to a desired yarn size. Subsequently, the sliver 1 moves through a pneumatic false-twisting device 5, which it leaves as a yarn 6, which, by means of a pair of withdrawal rollers 7, 8, is withdrawn in the direction of the arrow (B) and is fed to a wind-up device which is not shown. The withdrawal roller 7 is constructed as a shaft which extends through in the longitudinal direction of the machine and is driven at the machine end.

The pneumatic false-twisting device 5 contains at least one air nozzle 9, which is arranged behind the pair of delivery rollers 3, 4 of the drafting unit 2 and which is arranged on a nozzle holder 10. In practice, several air nozzles are customarily arranged behind one another, in which case, the first air nozzle, nozzle 9, is used essentially for sucking up the sliver 1 leaving the drafting unit 2, while the next air nozzle or nozzles are constructed as so-called false-twisting nozzles.

The nozzle holder 10, in the area of its lower end, is disposed on a lever 12 so that it can be pivoted around a shaft 11. This lever 12 is in turn disposed at a stationary holder 14 so that it can be pivoted around a shaft 13 which is parallel to the shaft 11, both shafts extending horizontally. In the operative position, the lever 12 is supported on a stop 15, against which it is pressed by means of a leaf spring 31, which, while being prestressed, is fastened at a stationary component 32. Between a pin 18 of the nozzle holder 10 and a pin 19 of the lever 12, a tension spring 17 is arranged which pulls the nozzle holder 10 with a stop 21 onto a holder 22. The holder 22 is fastened at a component, which is not shown, and is held at this component by means of a screw 23 which is placed in a vertically aligned longitudinal slot 24. As a result, the holder 22 can be adjusted in the vertical direction.

The stop 21 is provided with a notch 25 by means of which it reaches, from below, in a locking manner around the rounded-off lower edge of the holder 22.

The stop 15 may, for example, be the armature of a solenoid 16 and may be pulled out of the travel path of the level 12. The solenoid 16 is controlled by a yarn guard, which is not shown, in such a manner that, in the event of a yarn breakage, the stop 15 is pulled out of the swivelling range of the lever 12. The leaf spring 31 will then press the lever 12 downward, in which case the nozzle holder 10 is also lowered. This lowering movement is supported also by the dead weight. The lever 12, which moves into position 12' indicated by an interrupted line, will then move against a stop 33 which preferably is elastic and is arranged on a stationary component. The tension spring 17 holds the nozzle holder 10 fast in such a manner that, with a stop face 20, it slides downward along the holder 22 until a second notch 34 is reached so that then the nozzle holder 10 swivels in the direction of the holder 22, and the notch 34, in a locking manner, reaches around the lower end of the holder 22. The nozzle holder 10 will then be located in the inoperative position 10', which is shown by a dash-dotted line and which is called the piecing position.

As shown by means of an arrow 36, the nozzle holder 10, which is equipped with a handle 37, can be swivelled in the direction of the arrow 36 around the (lowered) shaft 11, so that then the whole nozzle holder 10 is located approximately horizontally, and the nozzles, including the air nozzle 9, are easily accessible.

Each spinning unit also contains a suction tube 28 which is disposed around a horizontal shaft 29 on a stationary holder 30. The suction tube 28 is connected to a vacuum source, which is not shown. In the shown operative position, the mouth 35 of the suction tube 28 is aimed at the outer circumference of the roller 3, specifically at an area which is approximately diametrically opposite the area of the clamping gap of the pair of delivery rollers 3, 4.

The suction tube 28 is held in this position by means of a supporting element 26, which is fastened at the nozzle holder 10 and against which a supporting surface 27 rests of a suction tube 28. The suction tube 28 is equipped with a torsion spring, which is not shown and which generates a pressing force in the direction of the arrow 38, by means of which the suction tube 28 is pressed against the supporting element 26.

As explained above, in the event of a yarn breakage, the nozzle holder 10 with the nozzle 9 reaches the piecing position 10', the supporting element 26, which is fastened at it, also being lowered to position 26'. As a result of the spring force acting in the direction of the arrow 38, the suction tube 28 follows this movement so that the supporting surface 27 takes up position 27', in which it rests against the supporting element 26 located in position 26'. The suction tube 28 will then take up the piecing position 28' indicted by a dash-dotted line. The mouth 35, which will then be located in position 35', is located essentially below the clamping gap of the pair of delivery rollers 3, 4.

In the event of a yarn breakage, the supply of the drafting unit 2 is interrupted, which is also controlled by a yarn guard, which is not shown and which may be identical with the yarn guard controlling the lowering of the nozzle holder 10. The interrupting of the supply of the drafting unit 2 takes place by a moving-apart of the pairs of rollers of the drafting unit 2; i.e., also of the pair of delivery rollers 3, 4, and/or by the clamping-off of the sliver 1 moving into the drafting unit 2. Before a piecing, the drafting unit 2 is first switched on again, in that the rollers are again applied to one another and/or the clamping-off of the sliver 1 is undone. At the time of the starting of the drafting unit 2, the sliver 1 is not drawn perfectly. It is therefore provided that, during this time, the air nozzle 9 still remains in the piecing position 9', while the suction tube 28 is also held in the piecing position 28'. Therefore, the sliver 1, which enters first, is sucked off via the suction tube 28. It is only when the air nozzle 9 is returned to its operative position, that, at the same time, the suction tube 28 is returned to its cleaning position so that the air nozzle 9 sucks up the continuing sliver 1 which is now drawn correctly and corresponds to the desired yarn size.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. An arrangement for pneumatic false-twist spinning comprising:

a drafting unit including a pair of delivery rollers, air nozzle means including a movably held air nozzle, which follows the drafting unit in the travel direction of the yarn, a withdrawal device, nozzle transfer means for transferring the movably held air nozzle from an operating position behind the pair of delivery rollers of the drafting unit into a piecing position, which is offset with respect to the pair of delivery rollers, and a movably held suction tube which can be brought into a piecing position by means of suction tube adjusting means when the air nozzle is moved out of the operating position, in which piecing position the suction tube is applied to the area of a clamping gap of the pair of delivery rollers of the drafting unit, wherein the suction tube is in a cleaning position when the air nozzle is in the operating position, said suction tube being disposed at a distance from the clamping gap and being aimed at the circumference of one roller of the pair of delivery rollers of the drafting unit when in said cleaning position.

2. An arrangement according to claim 1, wherein the suction tube is arranged on a holder and can be swivelled between the piecing position and the cleaning position.

3. An arrangement according to claim 2, wherein the suction tube is coupled with the air nozzle in such a manner that it follows the movement of the air nozzle such that, when the air nozzle is located in the piecing position, the suction tube is also in the piecing position.

4. An arrangement according to claim 3, wherein the suction tube, is pressed by means of spring force, against a supporting element of the air nozzle.

5. An arrangement according to claim 2, wherein the suction tube, is pressed by means of spring force, against a supporting element of the air nozzle.

6. An arrangement according to claim 1, wherein the suction tube is coupled with the air nozzle in such a manner that it follows the movement of the air nozzle such that, when the air nozzle is located in the piecing position, the suction tube is also in the piecing position.

7. An arrangement according to claim 6, wherein the suction tube, is pressed by means of spring force, against a supporting element of the air nozzle.

8. An arrangement according to claim 1, wherein the suction tube, is pressed by means of spring force, against a supporting element of the air nozzle.

* * * * *